United States Patent [19]

Schwarz

[11] 4,332,279

[45] Jun. 1, 1982

[54] CONNECTING ROD BETWEEN THE HEDDLE FRAME OF A WEAVING MACHINE AND THE HEDDLE FRAME ACTUATING DEVICE OF THE SHED-FORMING MACHINE WHICH CONTROLS SAME

[75] Inventor: Rudolf Schwarz, Horgen-Zuerich, Switzerland

[73] Assignee: Staeubli Ltd., Horgen-Zuerich, Switzerland

[21] Appl. No.: 109,431

[22] Filed: Jan. 3, 1980

[30] Foreign Application Priority Data

Jan. 9, 1979 [SE] Sweden ..... 79162

[51] Int. Cl.[3] ..... D03C 1/14; D03C 11/00

[52] U.S. Cl. ..... 139/82; 403/104

[58] Field of Search ..... 139/82, 84, 83, 57, 139/58; 403/104, 378, 379

[56] References Cited

U.S. PATENT DOCUMENTS

| | | | |
|---|---|---|---|
| 1,068,030 | 7/1913 | Whitmore | 403/104 |
| 2,139,446 | 12/1938 | Douglas | 403/104 |
| 2,386,161 | 10/1945 | Hawes | 403/104 |
| 3,222,095 | 12/1965 | Gerus | 403/104 |

FOREIGN PATENT DOCUMENTS

| | | | |
|---|---|---|---|
| 2131671 | 2/1973 | Fed. Rep. of Germany | 139/82 |
| 2205070 | 5/1974 | France | 139/82 |
| 2306604 | 10/1976 | France . | |
| 102722 | 2/1923 | Switzerland | 139/82 |
| 546842 | 3/1974 | Switzerland . | |

*Primary Examiner*—Henry Jaudon

*Attorney, Agent, or Firm*—Blanchard, Flynn, Thiel, Boutell & Tanis

[57] ABSTRACT

A connecting rod having two clamping rails between which are clamped plates extending in a plane perpendicular to the plane of the clamping rails. The clamping is accomplished by screws. The plates have pivot joints which can be moved into one another at their ends. The connecting rod is adjustable in length.

9 Claims, 5 Drawing Figures

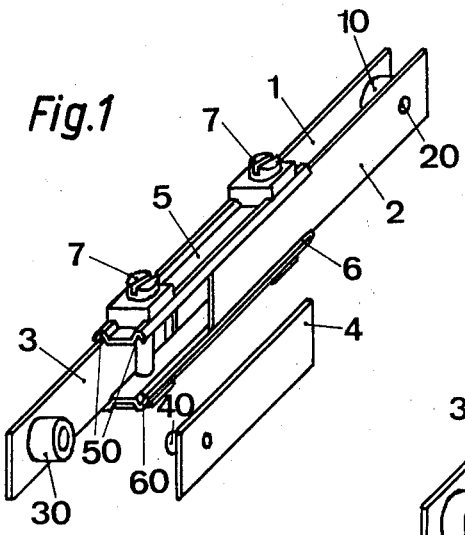
Fig.1
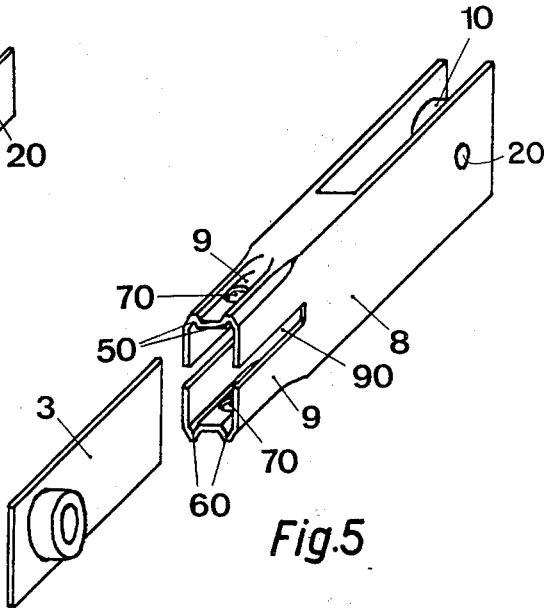
Fig.5
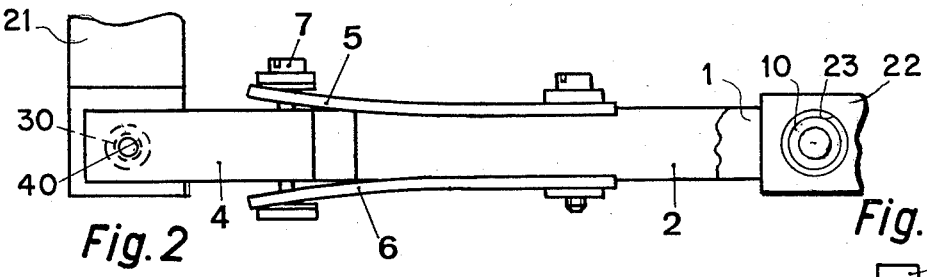
Fig.2
Fig.4
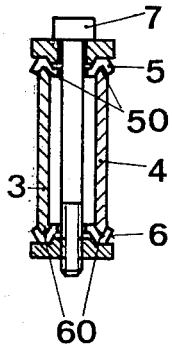
Fig.3
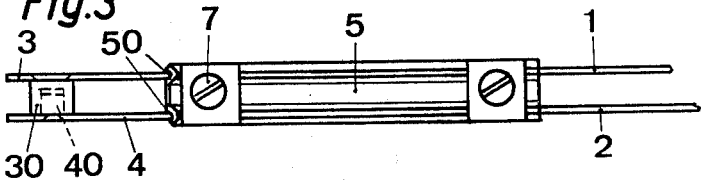

CONNECTING ROD BETWEEN THE HEDDLE FRAME OF A WEAVING MACHINE AND THE HEDDLE FRAME ACTUATING DEVICE OF THE SHED-FORMING MACHINE WHICH CONTROLS SAME

FIELD OF THE INVENTION

The invention relates to a connecting rod extending between the heddle frame of a weaving machine and the heddle frame actuating lever of a shed-forming machine which controls same, which connecting rod has at least one pivot joint arranged transversely with respect to the longitudinal direction and which consists preferably of two partial bolts which can be moved into one another and which rest on one another, wherein each partial bolt is secured to a plate which can be moved at least partially axially with respect to the pivot joint, and which is designated to be received in an opening of the heddle frame or the heddle frame actuating lever.

BACKGROUND OF THE INVENTION

In the case of form-lockingly operating weaving machines, the heddle frames are both during lifting and also during lowering operated directly by the shed-forming machine. This requires a rigid connection between the lifting units of the shed-forming machine and the weaving frame. Connecting elements are known, among others from Swiss Pat. No. 538 559, which are inserted into the heddle frame actuating device, in particular between the heddle frame and the free arm of a lever of the heddle frame actuating device. These connecting elements can carry out various functions. They create the hinged connection to the heddle frame and permit a problem-free exchange of the heddle frame during a changing of the fabric article on the weaving machine. They permit furthermore by changing their length, an adjustment of the basic position of the heddle frame. The connecting element achieves a play-free power transmission and if necessary an easy exchange in the case of a defect, while maintaining the power transmission both during the pull or draw cycle and also during the push cycle.

Such connecting elements have usually at least one pivot joint which rests between two sheet-metal plates, which bolt is connected to the free arm of a lever or with the heddle frame. Since modern weaving machines operate at high speeds, there exists the demand that these connecting elements are of a very low mass and yet still very strong. The heretofore used weldable material has proven to be of insufficient strength at high operating speeds and stresses.

The purpose of the invention is to provide a connecting element of a light, simple, however, strong structure, of a highly solid material, without using welding or soldering points during assembly. The requirement remains that the pivot joints for facilitating a quick exchange of the heddle frame can be installed and removed easily in axial direction out of the opening in the heddle frame or in the lever. Of course, the connecting element must be arranged within the heddle frame division and may not have any parts which project toward adjacent heddle frames. That is, the width of thickness of the heddle frame is to be equal to or less than the heddle frames.

SUMMARY OF THE INVENTION

The objects and purposes of this invention are met by providing a connecting rod of the above-mentioned type, which is characterized inventively by two clamping rails which are arranged spaced from one another corresponding with the width of the plates, which clamping rails are connected by at least one operable clamping member, wherein each clamping rail has on each side a groove extending along the longitudinal edge, the profile of which corresponds with the edge profile of the plates and the plates are arranged in pairs between the clamping rails.

BRIEF DESCRIPTION OF THE DRAWING

Exemplary embodiments of the invention are illustrated in the drawing, in which:

FIG. 1 is a perspective view of a connecting rod embodying the invention;

FIG. 2 is a side view of said rod in a released condition and engaged with a heddle frame and actuating lever;

FIG. 3 is a top view of the same rod;

FIG. 4 illustrates in an enlarged scale a cross-sectional view of said rod; and FIG. 5 is a perspective view of a modified embodiment.

DETAILED DESCRIPTION

The connecting rod according to FIGS. 1 to 4 consists of four plates 1,2 and 3,4, which cooperate with each other in pairs. One plate 1,3 of each plate pair has on one free end thereof a pivot bolt part which is a hollow bushing structure 10,30; each of the other plates 2,4 of each plate pair has a pivot bolt part which is a pin 20,40 which is received in the opening in the bushing. The plates are engaged on their edges by two elongated profiled rails 5,6 made of a springy material and clamped therebetween. Each profiled rail has an elongated groove 50,60 therein extending along the longitudinal side edges thereof. The cross sectional shape of the grooves corresponds with the shape of the edges of the plates, for example a V-shaped groove form and a V-shaped edge form. The rails 5,6 are clamped with the plates 1 to 4 positioned therebetween by means of several screws 7.

To install the connecting rod, for example in an opening in a heddle frame 21 (FIG. 2), at least one screw 7 is loosened. The springy clamping rails 5,6 are lifted or spread apart, as is illustrated in FIG. 2. The plate 4 can, as is illustrated in FIG. 1, be moved laterally in the axial direction of the pin 40 so that the bushing structure 30 can be introduced into a not-illustrated opening in the heddle frame 21. A fastening of the connecting rod to the heddle frame 21 occurs in a reversed sequence. The connecting rod can be connected to an actuating lever 22 by introducing the bushing 10 into an opening 23 in the lever 22 in a similar manner, as also shown in FIG. 2.

Two pairs of plates 1,3 or 2,4 are clamped in a single groove 50,60 in the clamping rails 5,6. To adjust the length of the connecting rod, it is sufficient to loosen at least one screw and to move the two plates which are connected together through a pin-bushing connection. With this, the length of the connecting rod and simultaneously the basic position of the heddle frame can be adjusted.

If the connecting rod is to be unchangeable in its length, the plates 1,3 or 2,4 can be made in one piece. FIG. 4 does not show the rails 5,6 cross hatched for reasons of clarity in illustration.

FIG. 5 illustrates a modified embodiment. Two of the side plates and the two clamping rails are connected to one single tubelike part 8 of rectangular cross section. A slot 90 exists between the clamping parts 9. However, one will recognize from the drawing that the grooves 50,60 and a bushing structure 10 are within the tubelike part 8. Reference numeral 3 identifies one of the two plates to be inserted. The plates 3 are in turn clamped between the grooves 50,60 by a not-illustrated screw received in slot openings 70. The part 8 may have continuous grooves 50,60 extending lengthwise of the connecting rod. The bushing 10 and pin 20 in FIG. 5 are similar to and cooperate in the same manner as the bushings 10 and 30 and pins 20 and 40 described hereinabove with respect to the embodiment of FIG. 1. The plates supporting the bushing 10 and pin 20 in FIG. 5 are flexible, so that the free ends thereof can be pulled away from each other to separate the pin 20 from engagement with the bushing 10.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an elongated connecting device extending between a heddle frame of a weaving machine and a heddle frame actuating lever of a shed-forming machine, at least one of said heddle frame and actuating lever having an opening therein and said connecting device having a pair of spaced plates and having pivot means on said plates releasably engageable with said opening for effecting a pivotal connection of said connecting device to said one of said heddle frame and said actuating lever, the axis of said pivot means extending transversely of said connecting device and said pivot means including two pivot bolt parts which engage one another, each said bolt part being secured to a respective said plate, the improvement comprising two clamping rails arranged opposite one another and spaced from one another a distance substantially equal to the width of a said plate and clamping means cooperable with said clamping rails for urging said clamping rails toward one another, each said clamping rail having adjacent each longitudinal edge thereof a groove and said plates being arranged between said clamping rails, each said groove in each said clamping rail engaging a respective edge of a respective said plate.

2. The connecting device according to claim 1, wherein said clamping rails have aligned openings therein and said clamping means includes a screw which extends through said openings in said clamping rails and a nut which threadedly engages said screw.

3. The connecting device according to claim 2, including two of said screws and two of said pairs of plates, said pairs of plates being arranged at respective ends of said clamping rails.

4. The connecting device according to claim 1 or 2, wherein said two clamping rails are each connected at one end thereof to a tube having a substantially rectangular cross section.

5. The connecting device according to claim 4, including a second pair of plates having pivot means thereon, said second pair of plates being flexible and being constructed on the end of said tube remote from said clamping rails.

6. The connecting device according to claim 1, wherein said clamping rails are flexible.

7. The connecting device according to claim 1, wherein said grooves in said clamping rails are V-shaped in cross section and the longitudinal edges of said plates are correspondingly V-shaped in cross section.

8. The connecting device of claim 1, including a said pivot bolt part provided at each end of each said plate.

9. The connecting device of claim 1, wherein one of said two pivot bolt parts is a bushing having a central opening therethrough and the other of said pivot bolt parts is a pin, said pin being slidably received within said central opening in said bushing.

* * * * *

UNITED STATES PATENT AND TRADEMARK OFFICE

CERTIFICATE OF CORRECTION

PATENT NO. : 4,332,279

DATED : June 1, 1982

INVENTOR(S) : Rudolf Schwarz

It is certified that error appears in the above—identified patent and that said Letters Patent is hereby corrected as shown below:

On the title page, priority data, "Sweden" should read -- Switzerland --.

Signed and Sealed this

*Twenth-eighth* Day of *September 1982*

[SEAL]

*Attest:*

GERALD J. MOSSINGHOFF

*Attesting Officer*

*Commissioner of Patents and Trademarks*